US010518942B2

(12) United States Patent
Seibert et al.

(10) Patent No.: US 10,518,942 B2
(45) Date of Patent: Dec. 31, 2019

(54) PACKAGE FITMENT HAVING A BIASING MEMBER

(71) Applicant: Berry Global, Inc., Evansville, IN (US)

(72) Inventors: Bryan K. Seibert, Haubstadt, IN (US); Eric Kost, Evansville, IN (US)

(73) Assignee: Berry Global, Inc., Evansville, IN (US)

( * ) Notice: Subject to any disclaimer, the term of this patent is extended or adjusted under 35 U.S.C. 154(b) by 0 days.

(21) Appl. No.: 15/710,598

(22) Filed: Sep. 20, 2017

(65) Prior Publication Data

US 2018/0079565 A1 Mar. 22, 2018

Related U.S. Application Data

(60) Provisional application No. 62/398,052, filed on Sep. 22, 2016.

(51) Int. Cl.

| | |
|---|---|
| ***B65D 47/08*** | (2006.01) |
| ***B65D 83/08*** | (2006.01) |
| ***B65D 43/22*** | (2006.01) |
| ***B65D 43/24*** | (2006.01) |

(52) U.S. Cl.

CPC ..... *B65D 47/0828* (2013.01); *B65D 43/22* (2013.01); *B65D 43/24* (2013.01); *B65D 83/0805* (2013.01)

(58) Field of Classification Search

CPC ..... B65D 51/18; B65D 47/0828; B65D 47/0823; B65D 47/0804; B65D 47/08; B65D 83/0805; B65D 83/08; B65D 43/24; B65D 43/22; B65D 43/16; B65D 43/168; B65D 43/163; B65D 43/169; B65D 43/164; B65D 45/22; B65D 45/16; B65F 1/16; B65F 1/1623

USPC ..... 220/254.5, 254.3, 254.1, 259.1, 256.1, 220/326, 324, 315, 830, 827, 834, 833, 220/832, 831, 810, 264, 263, 262; 206/581; 16/298, 308, 277

See application file for complete search history.

(56) References Cited

U.S. PATENT DOCUMENTS

| | | | | |
|---|---|---|---|---|
| 2,046,133 | A * | 6/1936 | Rathbun | B65D 43/168 16/DIG. 19 |
| 2,867,842 | A * | 1/1959 | Morton | E05F 1/1276 16/256 |
| 3,240,375 | A * | 3/1966 | Burrows | B65D 43/162 217/60 R |
| 5,542,567 | A | 8/1996 | Julius | |
| 5,542,568 | A | 8/1996 | Julius | |
| 5,573,132 | A | 11/1996 | Kanfer et al. | |
| 5,624,051 | A | 4/1997 | Ahern et al. | |
| 5,699,912 | A | 12/1997 | Ishikawa et al. | |
| 5,704,471 | A | 1/1998 | Yamada | |
| 5,729,955 | A | 3/1998 | Yamada | |

(Continued)

OTHER PUBLICATIONS

International Search Report and Written Opinion of corresponding international application No. PCT/US2017/052543 dated nailed Jan. 18, 2018, all enclosed pages cited.

*Primary Examiner* — Robert J Hicks

(57) ABSTRACT

A fitment suitable for use with a pouch or package, for example for dispensing wet wipes or the like, having a base and a lid member. The lid is movable between a closed position and an open position and includes a biasing member for biasing the lid toward the open position. The fitment may include a mechanical stop that limits the degree to which the lid may be opened.

20 Claims, 6 Drawing Sheets

(56) References Cited

U.S. PATENT DOCUMENTS 5,785,179 A 7/1998 Buczwinski et al.
5,860,742 A 1/1999 Faircloth et al.
5,996,797 A 12/1999 Flaig
6,032,827 A 3/2000 Zettle et al.
6,065,626 A 5/2000 Huang et al.
6,152,322 A 11/2000 Marino
6,206,221 B1 3/2001 Bando et al.
6,269,969 B1 8/2001 Huang et al.
6,299,017 B1 10/2001 Hill et al.
6,394,298 B1 5/2002 Zaidman et al.
6,401,968 B1 6/2002 Huang et al.
6,412,634 B1 7/2002 Telesca et al.
6,431,360 B1 8/2002 Julius et al.
6,499,626 B1 12/2002 Julius et al.
6,513,195 B2 * 2/2003 Haase ..... A61G 11/00 16/266
6,520,331 B2 2/2003 Okin et al.
6,554,156 B1 4/2003 Chong et al.
6,729,498 B2 5/2004 Yelton et al.
6,868,980 B2 3/2005 Cotterman et al.
6,889,867 B1 5/2005 Smith et al.
6,902,077 B1 * 6/2005 Tack ..... A47K 10/421 206/449
6,910,579 B2 6/2005 Sears et al.
6,942,118 B2 9/2005 Zethoff et al.
6,951,292 B2 10/2005 Bando et al.
6,971,542 B2 12/2005 Kwok et al.
6,986,434 B1 * 1/2006 Getsy ..... B65D 47/0828 220/254.3
7,000,792 B2 2/2006 Arai et al.
7,021,483 B2 4/2006 Tack et al.
7,025,220 B2 4/2006 Verespej et al.
7,140,492 B2 11/2006 Julius et al.
7,143,906 B2 12/2006 Chasid et al.
7,178,690 B2 2/2007 Chasid et al.
7,179,012 B2 2/2007 Bedi et al.
7,416,083 B2 8/2008 Bando
7,614,519 B2 11/2009 Krauth et al.
7,621,420 B2 11/2009 Hayashi et al.
7,665,629 B2 2/2010 Julius et al.
8,499,958 B2 8/2013 Wang et al.
8,573,398 B2 11/2013 Sears et al.
8,973,242 B2 3/2015 Murray et al.
2004/0089578 A1 5/2004 Lin et al.
2006/0096984 A1 5/2006 Bandoh et al.
2007/0075030 A1 * 4/2007 Delli Venneri .... B65D 47/0828 215/235
2010/0089926 A1 4/2010 Lacey et al.
2011/0309098 A1 * 12/2011 Hayashi ..... B65D 43/164 220/829
2012/0048858 A1 3/2012 Peters et al.
2013/0319966 A1 12/2013 Lane

* cited by examiner

PACKAGE FITMENT HAVING A BIASING MEMBER

PRIORITY CLAIM

This application claims priority under 35 U.S.C. § 119(e) to U.S. Provisional Application Ser. No. 62/398,052 filed Sep. 22, 2016, which is expressly incorporated by reference herein.

TECHNICAL FIELD

The present disclosure relates generally to a container fitment, and more specifically to a fitment having a maintainable open position.

BACKGROUND

It is often desirable to contain a product or article in a package or container for any of a variety of reasons, such as shipment, presentation on a store shelf, or storage in a way that increases the useful life of the product or article, for example. However, removal of the product or article from such a package or container by cutting or tearing, for example, may damage the package or container and/or may end or shorten the useful life of the package or container. For example, sanitary wipes may be wet or wetted with a liquid and/or chemical agent and packaged in a plastic pouch or container that prevents or inhibits moisture transfer therethrough and the drying of the sanitary wipes. If such a pouch or package is cut or torn open in a way that it cannot be sufficiently resealed, the useful life of the sanitary wipes or other articles contained within the package may be reduced.

To address such effects on the packaged article, reclosable and/or resealable closures have been developed. One example of a resealable closure includes a hinged lid fitment or closure that may be attached to or integral with the package or container. With such a fitment, the lid can be opened, the article accessed, and the lid closed thereby reclosing and/or resealing the package or container. However, even with a hinged lid fitment or closure, it can be difficult to open the lid, remove an article such as a sanitary wipe, and close the lid while still holding the wipe or article. In the case of a wet wipe or sanitary wipe, or similar article, the need can be increased due to the nature of the purpose for accessing the wipe or article.

SUMMARY

One or more embodiments in accordance with the present disclosure may address one or more of the aforementioned desires. Certain embodiments according to the present disclosure provide a fitment that includes a base having an opening that permits access through it. A lid may be operatively coupled to the base and have an open position relative to the opening and a closed position relative to the opening. The lid may include a lid protrusion. An elastic band may be included, and the elastic band may be coupled to a portion of the lid and/or coupled to a portion of the base, such that the elastic band is in tension when the lid is in the closed position relative to the base and such that the elastic band biases or urges the lid toward the open position. A latching mechanism may be used to overcome the bias of the elastic band to retain the lid in the closed position until the latch mechanism is released by a user input and the lid allowed to open. The base may have a component such as a base protrusion that may cooperate with a lid protrusion to form a mechanical stop when the lid is in the open position to prevent the lid from opening past a desired or predetermined angle or location.

In one aspect, for instance, some embodiments may provide a fitment having a base that has an opening that permits access therethrough. The base may include a base protrusion. The fitment may include a lid operatively coupled to the base. The lid may be movable between an open position relative to the opening and a closed position relative to the opening. The lid may include a lid protrusion. The fitment may include a biasing member coupled to the lid and also coupled to the base such that the biasing member urges the lid toward the open position when in the closed position relative to the base. The base protrusion and the lid protrusion may cooperate to form a mechanical stop when the lid is in the open position that prevents opening of the lid past the open position.

The biasing member may be an elastic band operative to open the lid upon a user input. The user input may be operation of a latch release mechanism. The biasing member may be an elastic band that is wrapped around the lid portion and the base portion and may form a continuous loop. The mechanical stop may be configured to prevent the lid from opening past a desired or predetermined angle. For example, the mechanical stop may prevent the lid from opening to about 180 degrees relative to the base. The mechanical stop may prevent the lid from opening past about 150 degrees relative to the base. The mechanical stop may prevent the lid from opening past about 120 degrees relative to the base. The mechanical stop may be operative while the biasing member is in tension to bias the lid toward a position beyond the mechanical stop. The biasing member may operate to rotatably open the lid relative to the base.

In another aspect, some embodiments may provide an apparatus that includes a base having an opening therethrough and a lid operatively coupled to the base. The lid may have an open position that substantially permits access through the opening of the base. The lid may have a closed position that prevents user access to the opening. In the open position, the lid may be at an angle of less than about 180 degrees relative to the base. An elastic band may be operatively coupled to the lid and the base portion, wherein the elastic band is in a first tension when the lid is in the closed position and in a second tension when the lid is in the open position. The first tension may bias or urge the lid toward the open position. A latch mechanism may be provided and may include a cooperating latch lid portion on the lid and a cooperating latch base portion on the base, wherein the latch lid portion and latch base portion are engaged while the lid is in the closed position and are not engaged when the lid is in the open position.

If included, the latch mechanism may provide a holding force sufficient to retain the lid in the closed position until the latch mechanism is released by a user input. A mechanical stop may be included and, if so, may be formed by cooperation of a lid protrusion coupled to the lid and a base protrusion coupled to the base when the lid is in the open position. The mechanical stop may provide a holding force sufficient to overcome the second tension and retain the lid in the open position. When in the open position, the lid may be at an angle of less than about 150 degrees relative to the base, at an angle of less than about 120 degrees relative to the base, at an angle in the range of about 100 degrees to about 120 degrees relative to the base, and/or at an angle of about 110 degrees relative to the base. The first tension and the second tension may vary in magnitude and/or direction when the base is in the same orientation relative to a horizontal plane. The elastic band may operate to rotatably open the lid relative to the base.

BRIEF DESCRIPTION OF THE DRAWINGS

Embodiments now will be described more fully hereinafter with reference to the accompanying drawings, in which some, but not all embodiments are shown. Indeed, embodiments may be illustrated or described in many different forms, and the present disclosure should not be construed as limited to the embodiments set forth herein; rather, these exemplary embodiments are provided for illustration and/or so that this disclosure will satisfy applicable legal requirements. Like numbers refer to like elements throughout, and wherein.

DETAILED DESCRIPTION

Embodiments now will be described more fully hereinafter with reference to the accompanying drawings, in which some, but not all embodiments are shown. Indeed, embodiments may take many different forms and the present disclosure should not be construed as limited to the embodiments set forth herein; rather, these exemplary embodiments are provided for illustration and/or so that this disclosure will satisfy applicable legal requirements. As used in the specification, and in the appended claims, the singular forms "a", "an", "the", include plural referents unless the context clearly dictates otherwise.

The terms "substantial" or "substantially" may encompass the whole as specified, according to certain embodiments of the invention, or largely but not the whole that is specified according to other embodiments of the invention.

Figure 1:
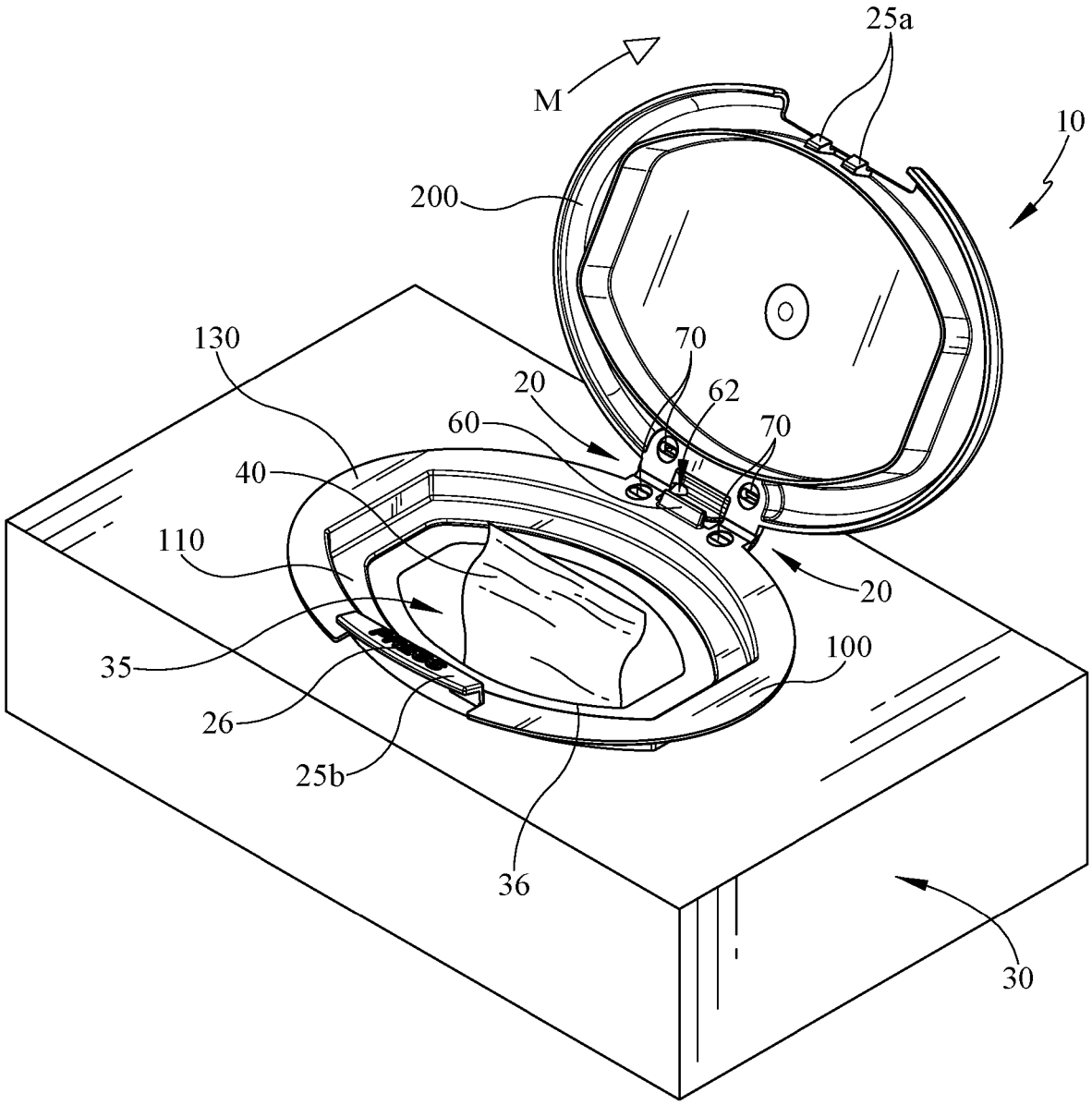
FIG. 1 illustrates a perspective view of an embodiment of a package with a pop-up fitment that is open to about 110 degrees.

Some embodiments of a fitment 10 may include or be used in conjunction with any of a variety of containers or packages, for example, containers for holding contents therein, such as a package 30 as illustrated in FIG. 1. In some embodiments, a fitment such as fitment 10 may be coupled to package 30. Package 30 may have an opening 35 to allow contents, such as a product or wipe 40, to pass from an interior region of package 30 to an exterior region of package 30. Optionally, package 30 may be substantially enclosed and/or sealed until a user desires to open it. For example, in some embodiments, opening 35 of package 30 may be substantially sealed off until a user desires to create or open opening 35. Optionally, a mechanism for facilitating forming opening 35 may be included, such as, for example, an opening line 36 that may facilitate punching or pulling open material covering and/or sealing opening 35. In some embodiments, opening line 36 may be substantially perforated, scored, and/or formed to facilitate opening package 30. This example of a mechanism to facilitate opening of package 30 is merely exemplary, and it is understood that any of a variety of mechanisms or a combination of mechanisms may be used to facilitate opening of package 30.

Package 30 illustrated in FIG. 1 may be of any of a variety of types or shapes of packaging or container, such as, for example, a pouch, a carton, a box, a tub, and/or a bucket, any other container or partial container, or any combination thereof. Moreover, package 30 may be formed of any of a variety of materials, such as, for example, plastic, plastic film, other types of film, paper, cardboard, foil, and/or metal, or any other material or any combination thereof. Wipes 40 are illustrated as an example of what may be included in package 30, but it is understood that any of a variety of contents or combination thereof, or no contents, may be included in package 30, and wipes 40 are merely one example. If wipes 40 are included, in some embodiments, wipes 40 may be wetted, saturated, and/or include a liquid. For example, wipes 40 may be sanitary wipes of the type that may be used to clean a user's hands and/or face, may be used to clean a child or infant, and/or may be used to clean household surfaces or other surfaces or objects. The type of wipes 40 or any other contents included within package 30 is virtually limitless, and the above examples are merely provided as examples of what may be included in package 30, if any contents are included. In the example of sanitary or wet wipes, in some embodiments, protecting or sealing off wipes 40 from the outside environment of package 30 for as long as possible or practical may increase the life of wipes 40. Thus, in some embodiments, package 30 may be substantially sealed off from the environment until opening 35 is formed.

As shown in FIG. 1, access to wipes 40 and/or to the interior of package 30 may be provided with inclusion of a fitment 10. If included, fitment 10 may be coupled to, attached to, and/or integral with package 30. Fitment 10 may have a closed position, in which opening 35 is substantially closed off and/or access to the inside of package 30 has been blocked off, and an open position, in which opening 35 is open and the contents of package 30 may be accessible. In some embodiments, fitment 10 may include a base 100 and a lid 200. Base 100 may attach and/or couple to package 30 by any of a variety of mechanisms, such as, for example, base 100 may include an outer flange 130 and/or an inner flange 110 that may mate and/or couple with package 30. For example, either or both of outer flange 130 and inner flange 110 may be glued, adhered, welded, and/or fastened to package 30, or any combination thereof. As shown in FIGS. 2-5, base 100 may have formed therein an opening 120, which in some embodiments may be substantially defined and/or bordered by inner flange 110 and/or outer flange 130. Opening line 36, if included, and inner flange 110 may be cooperatively shaped to facilitate the passing of one or more wipes 40 out of package 30 and/or through base 100 (such as is shown in FIG. 1, for example).

In some embodiments, fitment 10 may be configured in such a way that it may be made to form a closed position by having lid 200 substantially cover opening 120 formed in base 100. An exemplary embodiment of a fitment 10 in a closed position is shown from various angles in FIGS. 6-9. As can be seen in FIGS. 6-9, in this embodiment of fitment 10, a closed position may be formed when lid 200 and base 100 are parallel and/or are adjacent with one another. In such a closed position, lid 200 and base 100 may form about a zero degree angle relative to one another such as about a hinge 20, for example. See FIG. 3 for an illustration of angle θ when fitment 10 is an exemplary open position.

Fitment 10 may also be configured to form one or more seals, partial seals, air or liquid flow barriers or obstructions, any other feature, and/or any combination thereof when in a closed position. For example, referring back to FIGS. 1-3, base 100 and/or lid 200 may include one or more surfaces, projections, lips, borders, other features, and/or any combination thereof to form one or more seals or partial seals when fitment 10 is in a closed position. Such examples may include, but are not limited to, a lid lip 230 and/or a lid border 240, either or both of which, if included, may project downwardly and/or outwardly from a lid cover 210 in such a way that lid lip 230 and/or lid border 240 extend toward, into, and/or around base 100 or some portion thereof.

Base 100 may include one or more features to cooperate with lid 200 or one or more portions thereof to form one or more seals, partial seals, air or liquid flow barriers or obstructions, any other feature, and/or any combination thereof when in a closed position. It is understood that base 100 and/or lid 200 may include such features alone or irrespective of the other, or may include such features cooperatively with each other. For example, base 100 may include inner flange 110, outer flange 130, and/or any of a variety of walls such as first side wall 131, second side wall 132, front wall 133, and/or rear wall 134. If included, any or all of these flanges or walls, and/or additional flanges, walls, or other features may cooperate with, engage with, and/or mate with lid cover 210, lid lip 230, and/or lid border 240, if lid 200 includes any or all of those features. For example, in some embodiments a portion of lid cover 210 such as that between lid lip 230 and lid border 240 may substantially mate with and/or lie adjacently parallel with outer flange 130 of base 100 to form a first outer seal around opening 120 or any portion thereof while a portion of lid cover 210 inside of lid lip 230 covers opening 120.

Figure 2:
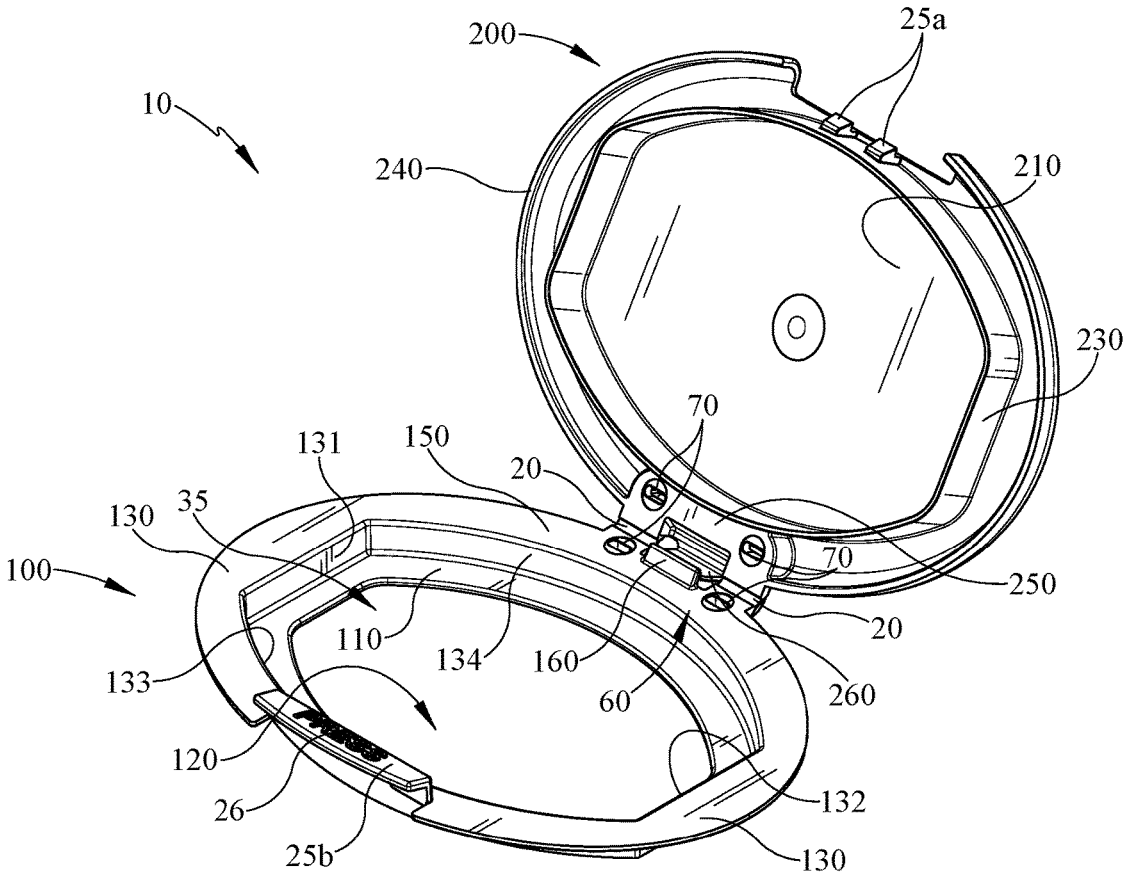
FIG. 2 illustrates a perspective view of the pop-up fitment of FIG. 1.

As illustrated for example in FIG. 2, in some embodiments, an inner seal may be formed instead of or in addition to the first outer seal by, for example, configuring, adapting, sizing, and/or shaping lid lip 230 or any portion thereof to engage, mate with, and/or lie adjacently with any or all of walls 131, 132, 133, 134 and/or inner flange 110 of base 100. For example, lid lip 230 or any portion thereof may extend outwardly from lid cover 210.

Figure 7:
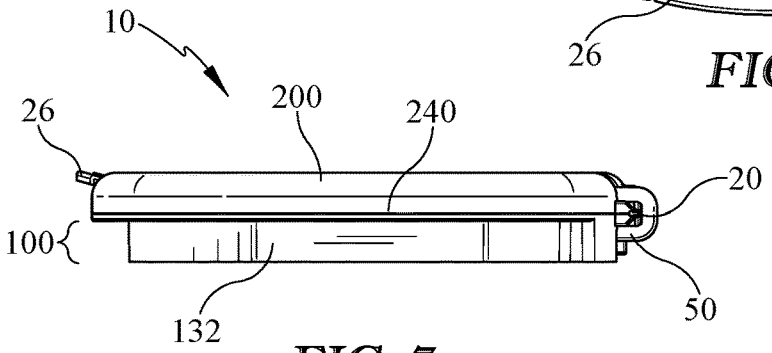
FIG. 7 shows a side view of the pop-up fitment shown in FIG. 6.
Figure 8:
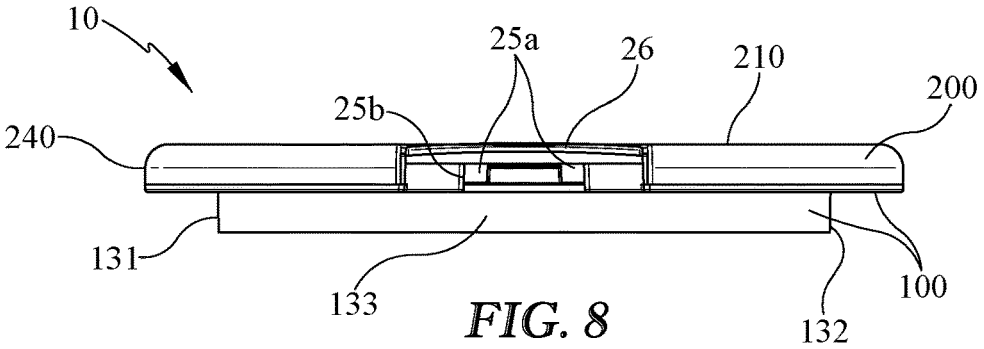
FIG. 8 shows a front view of the pop-up fitment shown in FIG. 6.

As shown in FIGS. 2 and 7, for example, a second outer seal may also be formed in addition to or instead of either or both of the aforementioned first outer seal and inner seal. For example, lid border 240 and/or another peripheral portion of lid cover 210 may be configured, adapted, sized, and/or shaped to mate with, engage, and/or lie adjacently parallel outer flange 130 of base 100 or any portion thereof. In some embodiments, border 240 may extend outwardly from lid cover 210 so that it may engage, mate with, and/or surround outer flange 130 or any portion thereof, including an outer peripheral portion.

Figure 3:
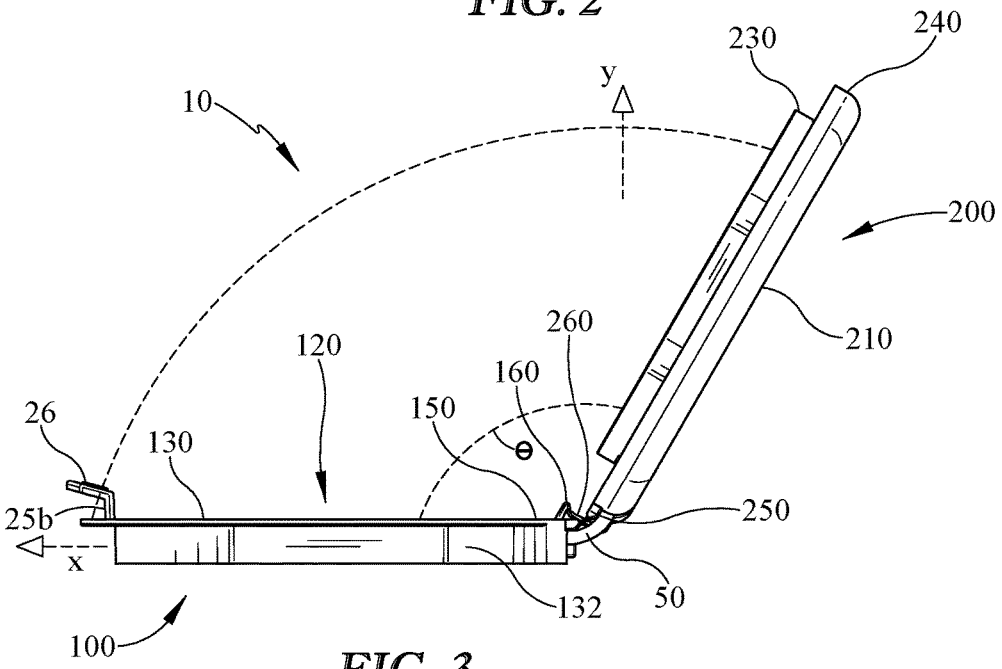
FIG. 3 illustrates a side view of the pop-up fitment of FIG. 2 open to about 110 degrees.

Base 100 and lid 200 may be operatively coupled or connected so that lid 200 may be opened relative to base 100 and/or provide access to package opening 35, wipes 40, and/or the interior of package 30, for example as shown in FIGS. 1-3. Fitment 10, base 100, and/or lid 200 may be configured in any of a variety of ways to be movable, translatable, and/or rotatable between one or more closed positions and one or more open positions. It is understood that, while shown as substantially oval in shape, fitment 10, base 100, lid 200, and/or any component thereof may be oval or any other shape or combination of shapes, including, but not limited to, square, rectangular, circular, triangular, polygonal, free form, or any other shape, or any combination thereof.

Figure 4:
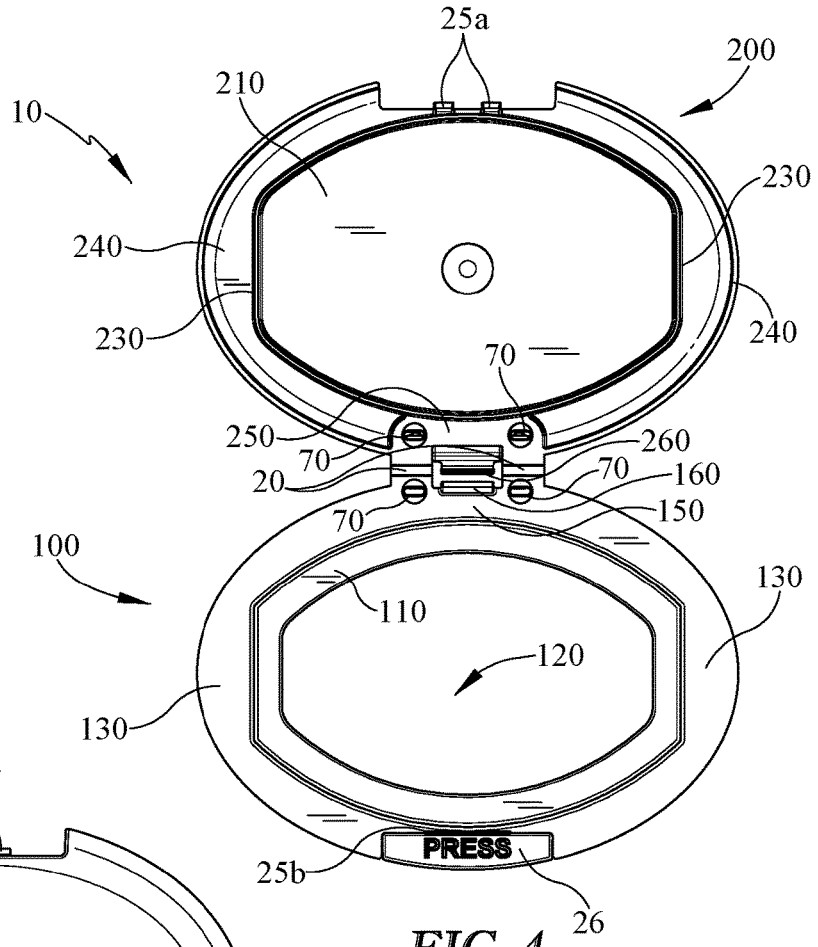
FIG. 4 illustrates a top view of an embodiment of a pop-up fitment open to about 180 degrees.
Figure 5:
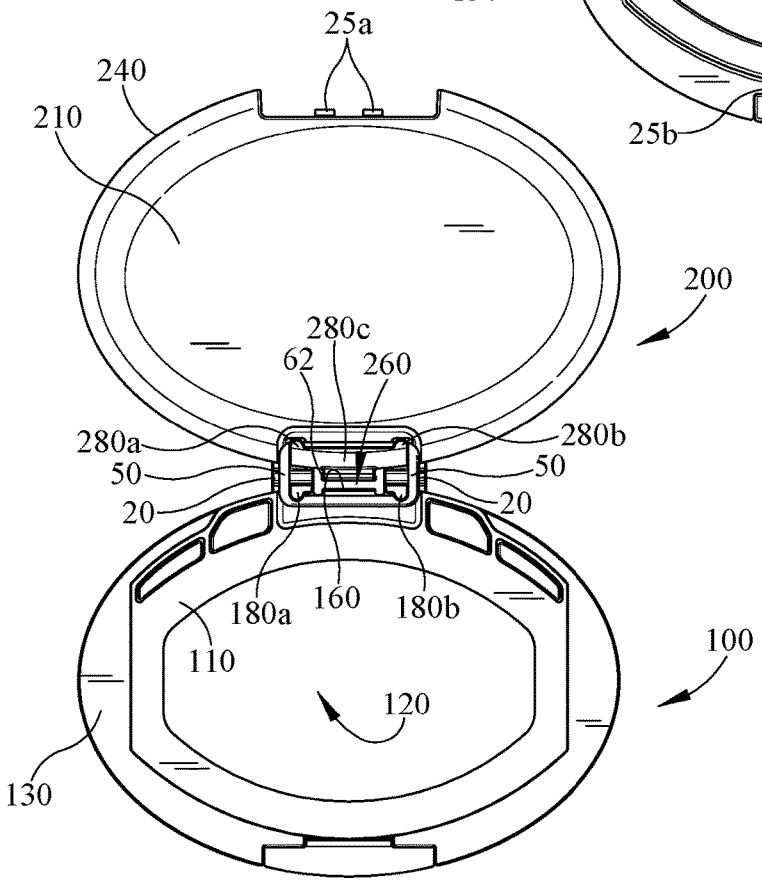
FIG. 5 shows a bottom view of the pop-up fitment shown in FIG. 4 with an embodiment of an elastic band coupled to a lid and a base of the fitment.
Figure 6:
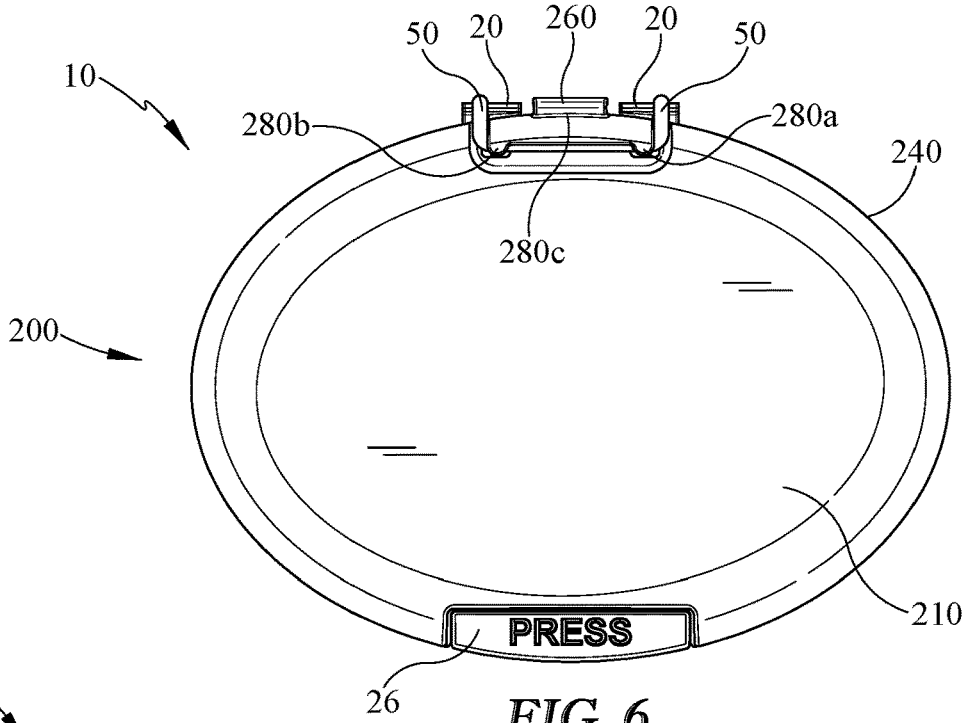
FIG. 6 shows a top view of an embodiment of a closed pop-up fitment.

Fitment 10 may be configured or adapted to form one or more open positions in which opening 120 or a portion thereof is substantially uncovered and/or unobstructed by lid 200, such as shown in FIGS. 1-3, for example. A first exemplary open position is illustrated in FIGS. 4 and 5, and shows lid 200 at about 180 degrees relative (as measured by angle θ about hinge 20 shown in a different open position in FIG. 3) to base 100 and/or substantially coplanar with base 100. It is understood that this is merely one example of an open position, and any of a variety of open positions may be formed by fitment 10, including at angles greater than 180 degrees and/or at angles less than 180 degrees and any angles between 0 and 270 degrees. It is further understood that fitment 10 may have any number of open positions.

In some embodiments, fitment 10 may be formed so that the degree lid 200 may open relative to base 200 may be controlled. For example, in some embodiments, fitment 10 may be formed so that lid 200 may rotate about hinge 20 until it is nearly or substantially coplanar (or at a 180 degree angle) with base 100, such as is shown in FIGS. 4 and 5, for example. In some embodiments, fitment 10 may be formed so that the rotational movement of lid 200 relative to base 100 is limited before lid 200 opens to or beyond 180 degrees. For example, as shown in FIGS. 1-3, lid 200 may open to approximately 110 degrees, after which point further opening may be prevented or inhibited by a mechanism such as mechanical stop 60, for example. Angle θ may be measured relative to an x-axis which may lie in a plane coplanar with base 100, where a y-axis is perpendicular to the x-axis, as shown in FIG. 3. For example, the x-axis may lie in a horizontal plane and the y-axis may lie in a vertical plane.

As shown in FIG. 3, angle θ may be about 110 degrees. Additionally or alternatively, lid 200 may open to any of a variety of angles, including but not limited to in the range of about 90 degrees to about 180 degrees, and/or in the range of about 100 degrees to about 150 degrees, and/or in the range of about 100 degrees to about 120 degrees. In some embodiments, lid 200 may tend to fall or self-close under its own weight if not opened to about 90 degrees relative to the horizontal, and/or lid 200 may tend to fall or self-close if approximately 90 degrees but package 30 and/or fitment 10 is tilted. It is understood that the angle may be altered or modified as desired, and the aforementioned examples are provided as non-limiting illustrative purposes only.

Figure 10:
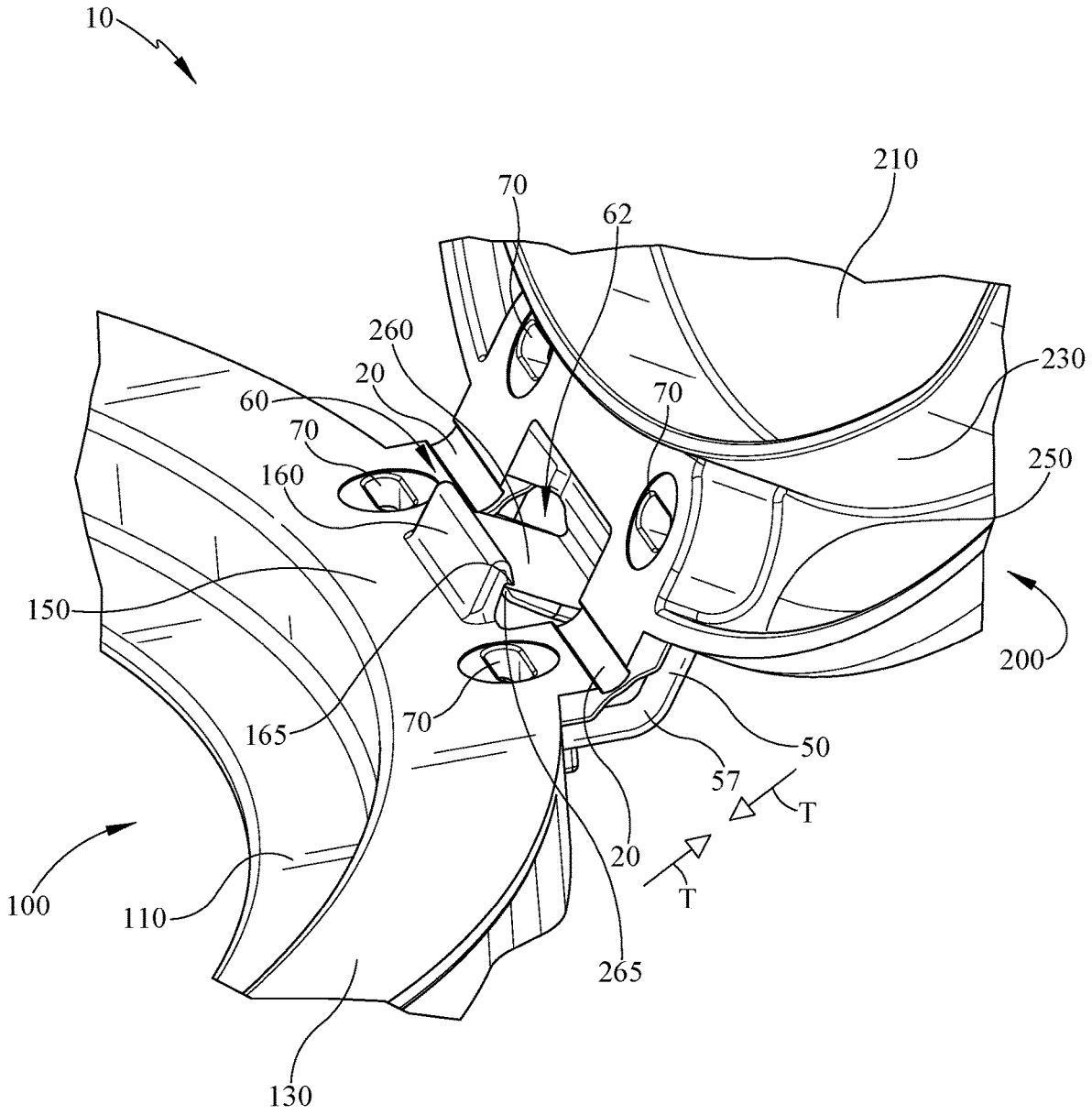
FIG. 10 shows a perspective view of a portion of an embodiment of a pop-up fitment, with a hinge, a mechanical stop, and an elastic band.

Mechanical stop 60, if included, may include any of a variety of features, including, but not limited to, a base protrusion 160 integral with and/or coupled to base 100, and a lid protrusion 260 integral with and/or coupled to lid 200, as shown for example in FIG. 10. Base protrusion 160 and lid protrusion 260 may be sized and shaped so that they will form mechanical stop 60 used to hold lid 200 at the desired position relative to base 100 (such as at angle θ shown in FIG. 3). By including base protrusion 160 on base 100 and/or lid protrusion 260 on lid 200, with lid 200 and base 100 rotating relative to each other, the opening rotational motion of lid 200 relative to base 100 may cause base protrusion 160 and lid protrusion 260 to rotate into position and/or contact each other to form mechanical stop 60, which may prevent opening past angle θ.

Mechanical stop 60 may be formed in any of a variety of ways. For example, referring again to FIG. 10, in some embodiments mechanical stop 60 may be formed by the physical contact of one or more lid protrusion ends 265, which may be located at or near an end of one or more lid protrusions 260, and one or more base protrusion lips 165, which may be located at or near an end of one or more base protrusions 160. The location and/or geometry of mechanical stop 60 may be used to control the angle to which lid 200 may be opened. The location and/or geometry of mechanical stop 60, in turn, may be set, determined, and/or controlled by the geometry, size, location, and/or shape of lid protrusion 260 or a portion thereof, base protrusion 160 or a portion thereof, or both.

Figure 11:
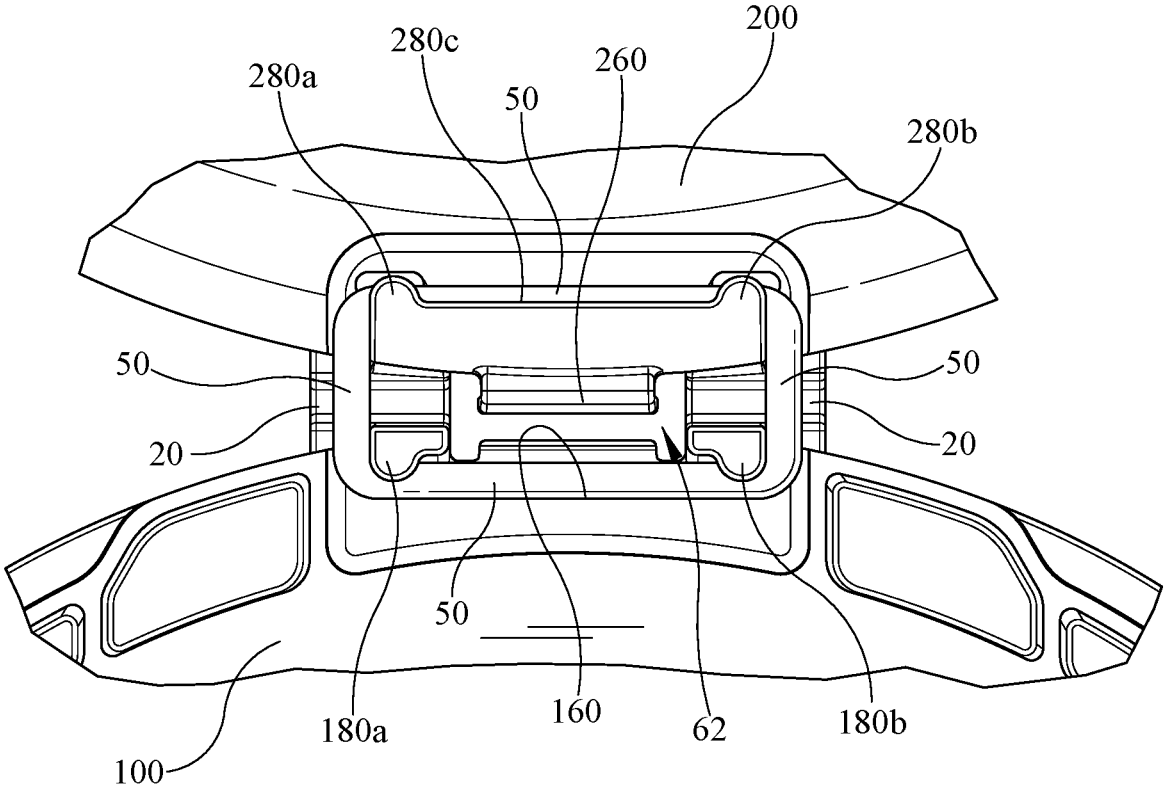
FIG. 11 shows a bottom view of a portion of the pop-up fitment of FIG. 10.

Lid protrusion or a portion thereof may form an L-shape and/or extend in two directions. For example, lid protrusion 260 may extend rearwardly outwardly from a rear portion 250 of lid 200, and then may extend downwardly outwardly to lid protrusion end 265, such as shown in FIGS. 10 and 11, for example. In such an embodiment, lid protrusion 260 may form a substantially L-shaped member and/or may be bent or angled so that lid protrusion end 265 may be located at an offset in two directions from rear portion 250 of lid 200. It is understood that lid protrusion end 265 may be offset in more than two directions, less than two directions, or not at all from lid rear portion 250, and this is merely one example of how lid protrusion 260 may be formed to facilitate formation of mechanical stop 60. It is further understood that lid protrusion 260 may from a substantially 90 degree angle as shown in FIG. 10, but may be less than or more than 90 degrees. Further still, it is understood that, while one lid protrusion 260 is illustrated in FIG. 10, any number of lid protrusions 260 may be included and may be of the same, similar, or varying configuration, size, shape, location, and/or geometry. It is also understood that, while some directional terms are used herein, such as top, bottom, up, down, rear, front, length, width, and the like, these terms are not intended to be limiting but rather to relate to one or more exemplary orientations, positions, and/or configurations of package 30, fitment 10, and/or any component thereof.

Continuing this exemplary embodiment illustrated in FIG. 10, base protrusion 160 may extend upwardly and/or rearwardly outwardly from a location at or near base rear portion 150 and/or may include base protrusion lip 165. If included, base protrusion lip 165 may be sized, shaped, configured, and/or located so as to catch lid protrusion 260 and/or lid protrusion end 265 as lid 200 rotates relative to base 100 such as it may rotate about hinge 20. Thus, it may be appreciated that the size, shape, location, geometry, and/or configuration of base protrusion 160 and/or base protrusion lip 165 may be dependent on the size, shape, location, geometry, and/or configuration of base protrusion 160 and/or lid protrusion end 265, or vice versa, in certain embodiments.

If included to form mechanical stop 60 or for any other reason, base protrusion 160 may extend substantially upwardly and rearwardly away from base 100 (when fitment 10 and/or base 100 is oriented as shown in FIG. 10, for example) and/or serve to locate protrusion lip 165 in the path of a counterpart used to form mechanical stop 60 that is coupled with lid 200, such as lid protrusion 260 and/or lid protrusion end 265 for example. It is understood that base protrusion 160 need not be angled upwardly or rearwardly, or both, relative to base 100. In some embodiments, base protrusion 160 may be substantially vertical with a horizontally rearwardly extending base protrusion lip 165. In some embodiments, an indent, recess, lip, or the like may be formed into or below the rear wall of base 100, one or more of which may be used instead of or in addition to base protrusion lip 165 to form mechanical stop 60. In other embodiments, no such feature may be included and any component or subcomponent of base 100 and/or band 50 may be used to catch any component or subcomponent of lid 200 to form mechanical stop 60, if mechanical stop 60 is included.

If included to form mechanical stop 60 or for any other reason, lid protrusion 260 may extend substantially downwardly and/or rearwardly away from lid 200, for example when lid 200 is in a closed position with base 100 below it, and/or serve to locate lid protrusion lip 265 so that it may contact a counterpart used to form mechanical stop 60 that is coupled with base 100 as lid 200 is opened, as shown in an exemplary embodiment of FIGS. 10 and 11. It is understood that, while shown as a substantially L-shaped protrusion with a horizontal extension and a vertical extension, lid protrusion 260 may be of any of a variety of shapes, if included at all. For example, lid protrusion 260 may be substantially curved, may be substantially straight (horizontal, vertical, or angled), or any other shape or combination thereof, if included at all. It is understood that mechanical stop 60 may be formed without any extension or protrusion from lid 200, for example, by forming a counterpart in base 100 such as base protrusion 160, or in band 50, in such a way as to form a mechanical stop without need for an extension from lid 200. It is understood that the figures merely illustrate exemplary embodiments.

Base protrusion 160 and/or lid protrusion 260, as shown for example in FIGS. 10 and 11, may be formed of any suitable material, such as, for example, plastic, any other suitable material, or any combination thereof. Base protrusion and/or lid protrusion 260 may be formed integrally with, coupled with, and/or attached to base 100 and/or lid 200, respectively. In some embodiments, base protrusion 160 and/or lid protrusion 260 may be rigid or semi-rigid in material and/or connection to base 100 and/or lid 200 to provide sufficient structural support to maintain fitment 10 in a desired open position despite the weight of lid 200, base 100, other portions of fitment 10, and/or any forces, motions, or movements that fitment 10 is intended to withstand.

One example of how base 100 and lid 200, as shown in exemplary embodiments in FIGS. 1-11, may be operatively connected and/or may be movable, translatable, and/or rotatable between one or more closed positions and one or more open positions is with one or more hinges 20. Hinge 20 may allow motion of lid 200 relative to base 100 when subject to an opening motion M as shown for example in FIG. 1. Opening motion M may be manual, for example, when a user pushes, pulls, rotates, or otherwise causes opening motion M, it may be automatic, for example, caused by a force other than a manual force, such as by a biasing member like elastic band 50 discussed more below, or it may be a combination of manual and automatic, or caused by any other force or mechanism.

Figure 9:
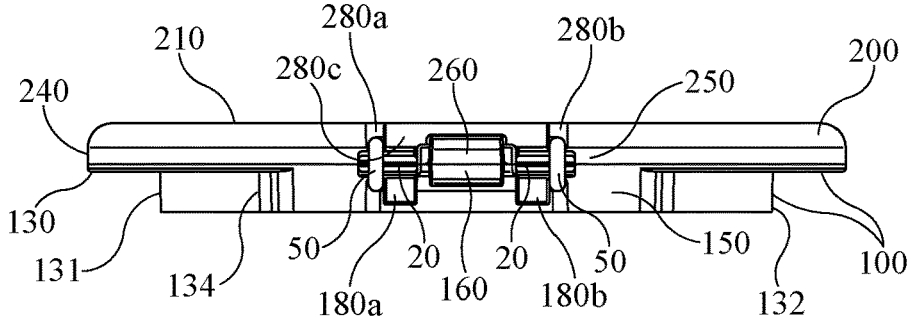
FIG. 9 shows a back view of the pop-up fitment shown in FIG. 6.

Hinge 20 as shown in FIGS. 7, 9, and 11, for example may be any of a variety of types of hinge or any combination thereof, such as, for example, a living hinge with an area of reduced material to facilitate bending. In some embodiments, hinge 20 may have more than one area of reduced material to facilitate bending. Hinge 20 may be other than a living hinge, or may include another type of hinge in addition to a living hinge. For example, hinge 20 may include a bi-fold hinge, a butterfly hinge, a ball-and-socket type hinge, a butt hinge, a case hinge, a concealed hinge, a continuous hinge, a flag hinge, a gate hinge, a knife hinge, a latch hinge, an offset hinge, a piano hinge, a slip joint hinge, a spring-loaded hinge, a strap hinge, a swage hinge, a T hinge, a weld hinge, any other type of hinge, or any combination thereof.

Furthermore, hinge 20 may be made of any of a variety of materials, including, but not limited to, plastic, wood, metal, any other material or any combination thereof. In some embodiments, hinge 20 may be formed of plastic. In some embodiments, hinge 20 may be formed or made contemporaneously with base 100 and/or lid 200 and/or it may be formed or made from the same material. In certain embodiments, hinge 20 may be formed integrally and/or of the same material as the lid 200, base 100, and/or any other component of fitment 10. It is understood that hinge 20 does not need to be integral with any other component of fitment 10, and may be attached to or coupled with any component of fitment 10, such as lid 200 and/or base 100, instead of or in addition to being integrally formed therewith.

To facilitate forming mechanical stop 60, or for any other reason, an opening, recess, or aperture 62 may be formed in base 100, lid 200, in both, or in between the two, or in any combination thereof, as shown for example in FIGS. 10 and 11. Aperture 62 may allow base protrusion 160, lid protrusion 260, or both to pass therethrough to form mechanical stop 60. Aperture 62 may, in some embodiments, be formed between one or more hinges 20, such as is illustrated in the figures. It is understood that aperture 62 is not required, and, for example, mechanical stop 60 may be formed on either side of hinge 20 and/or outside hinge 20 instead of, or in addition to, in or through aperture 62. It is further understood that any number of hinge or hinges 20 and/or any number of aperture or apertures 62 may be included, including zero.

Lid 200 may be biased toward an open position relative to base 100 and/or package opening 35 by use of one or more biasing members or mechanisms, such as one or more elastic bands 50 attached to lid 200 and/or base 100 in such a way that elastic band 50 may be in tension T. Tension T may cause rotation of lid 200 relative to base 100, for example, about one or more hinges 20. Elastic band 50 may be sized and/or shaped to be in tension T when the lid 200 is in a closed position and may bias lid 200 toward an open position relative to base 100, and/or elastic band 50 may be sized and/or shaped so that it is in tension T while in an open position, biasing lid 200 toward a more open position (i.e. toward a greater angle θ). It may be appreciated that in some embodiments wherein tension T biases lid 200 from an open position, such as that determined by mechanical stop 60 (e.g., about 110-120 degrees as shown in FIGS. 1-3), toward a more open position, a balance of forces between tension T and mechanical stop 60 may create a condition of equilibrium and/or may encourage lid 200 to remain in the desired open position. In such embodiments, tension T may encourage lid 200 to remain open at, for example, about 110-120 degrees, but may be of such magnitude that lid 200 may yet be closed (i.e. the opening bias of tension T overcome) with a single hand and/or a single finger of a user.

Moreover, the size, shape, number, and/or configuration of a mechanism biasing lid 200 toward an open position, such as elastic band or bands 50, may be designed, modified, and/or optimized to produce a desirable amount of opening force such as tension T. For example, elastic band 50 may be a substantially continuous loop of elastomeric material. Referring to FIGS. 5, 10, and 11, elastic band 50 is illustrated in a continuous loop, but may take any of a variety of shapes, including but not limited to oval, round, circular, square, triangular, polygonal, linear, curved, arced, or any other shape or configuration or any combination thereof. Elastic band 50 may be formed of or include any of a variety of materials. For example, a hypoallergenic and/or non-latex material may be desired for some applications, such as may be the case for medical or healthcare applications. One example of a material that may be used for such an application is latex free synthetic polyisoprene rubber.

In embodiments using a biasing mechanism such as tension T of elastic bands 50 as shown in FIGS. 7, 10, and 11, it may be appreciated that lid 200 may tend toward an open position and may not tend to stay in a closed position over opening 120 of base 100. For this reason or for any other reason, a latch mechanism 25 may be included. Latch mechanism 25 may include a cooperating lid portion 25*a* and base portion 25*b*. When lid 200 is in the closed position, latch lid portion 25*a* and latch base portion 25*b* may engage one another to form a latching or locking mechanism to prevent or inhibit lid 200 from opening. In some embodiments a latch release mechanism such as latch release 26 may be included to disengage latch 25 and allow lid 200 to open. For example, latch release 26 may be a depressible button or other actuatable device that a user may depress or engage to disengage latch lid portion 25*a* and/or latch base portion 25*b*, thereby allowing lid 200 to move, translate, and/or rotate toward an open position.

It is understood that, while an open position at which lid 200 is held open is shown for example in FIGS. 1-3 and 10 as occurring at about 110-120 degrees, this position or angle is merely exemplary. It is further understood that the desired angle of the open position, the desired location or position of mechanical stop 60, and/or the desired magnitude and/or direction of tension T may be modified and/or optimized based on the size, shape, configuration, and/or geometry of fitment 10, base 100, lid 200, and/or hinge 20. In some embodiments, the desired angle θ of the desired open position at which the mechanical stop or stops 60 engage(s) may be less than or more than about 110-120 degrees. For example, mechanical stop 60 may form when the open position occurs at an angle θ (see FIG. 3) of about 30 degrees or less, about 45 degrees or less, about 60 degrees or less, about 90 degrees or less, about 120 degrees or less, about 150 degrees or less, about 180 degrees or less, or about 180 degrees or more.

Referring now to FIG. 11, in some embodiments, one or more elastic bands 50 may be attached to and/or coupled with lid 200 and/or base 100 so as to form a partial or continuous loop around mechanical stop 60, base protrusion 160, lid protrusion 260, and/or aperture 62. Elastic band(s) 50 may be operatively coupled to lid 200 or a portion thereof and/or to base 100 or a portion thereof. Elastic band(s) 50 may be in a first tension when lid 200 is in a closed position and in a second tension when lid 200 is in an open position.

In some embodiments, one or more attachment features may be included in fitment 10 such as, for example, a first base attachment protrusion 180*a*, a second base attachment protrusion 180*b*, a first lid attachment protrusion 280*a*, a second lid attachment protrusion 280*b*, and/or a lid band channel 280*c*. Base attachment protrusions 180*a*, 180*b* may be attached at or near base rear portion 150 and/or may extend outwardly away from base 100. In this way, base attachment protrusions 180*a*, 180*b* may hold or maintain elastic band 50 in a position to form at least a partial loop or perimeter around aperture 62 if included. Lid attachment protrusions 280*a*, 280*b* may be attached at or near lid rear portion 250 and/or may extend outwardly away from lid 200. In this way, lid attachment protrusions 180*a*, 180*b* may hold or maintain elastic band 50 in a position and/or tension to form a partial loop or perimeter around aperture 62 if aperture 62 is included.

Any or all of attachment protrusions 180*a*, 180*b*, 280*a*, and 280*b* may include a curve, bend, and/or angle to facilitated holding elastic band 50 in place and/or preventing or inhibiting elastic band 50 from coming out of a desired position. While four attachment protrusion are shown in FIG. 11, and while two are on base 100 and two are on lid 200, it is understood that any number of attachment protrusions may be included and any number may be included on the base 100, the lid 200, or both. A feature such as lid band channel 280*c* may optionally be included to provide further support and/or protection for elastic band or bands 50. A similar feature may be included on base 100 instead of or in addition to on lid 200. It is understood that lid band channel 280*c* or a base band channel of similar or different design is/are optional, and no such feature is needed. If included, any or all of attachment protrusions or any other feature discussed herein may be formed in any of a variety of ways, including by injection molding. In those instances where injection molding or similar processes are used, it is understood that one or more reliefs or relief holes 70 may be included, such as those shown in FIG. 10, to allow formation of certain features such as attachment protrusions 180*a*, 180*b*, 280*a*, and 280*b*, lid band channel 280*c*, and/or protrusions 160, 260 by molding as well as removal of the mold from fitment 10 or any component thereof.

Although FIG. 1 illustrates package or container 30 as a substantially rectangular box, carton or pouch, and FIGS. 1-11 illustrate fitment 10 as substantially oval in shape, it is understood that container or package 30 and/or fitment 10 and/or any component thereof may be any of a variety of shapes or sizes, and the figures merely illustrate some exemplary shapes. For example, container 30 and/or fitment 10 may be substantially cylindrical, tubular, triangular, spherical, polygonal, free form, truncated or non-truncated, wider on top, wider on bottom, varying width or depth along its height, width, or depth, or substantially uniform in height, width, or depth. Package 30 and/or fitment 10 may have rounded corners, angled corners, straight corners, or no corners. It is further understood that container or package 30 and/or fitment 10 may be substantially rigid, substantially flexible, a hybrid of rigid and flexible, or any combination of rigid, flexible, and/or hybrid, such as having some areas be flexible and some rigid. It is understood that these examples are merely illustrative, are not limiting, and are provided to illustrate the versatility of options available in various embodiments of container or package 30 and/or fitment 10.

It is further understood that container 30 and/or fitment 10 and/or any component thereof may be made of any of a variety of materials, including, but not limited to, any of a variety of suitable plastics material, any other material, or any combination thereof. Suitable plastics material may include, but is not limited to, polypropylene (PP), polystyrene (PS), polyethylene (PE), high-density polyethylene (HDPE), polyethylene terephthalate (PET), crystallized polyethylene terephthalate (CPET), mixtures and combinations thereof, or any other plastics material or any mixtures and combinations thereof. It is understood that multiple layers of material may be used for any of a variety of reasons, including to improve barrier properties, to reduce weight and/or lightweight, or to provide known functions related to multiple layer structures. The multiple layers, if included, may be of various materials, including those recited herein.

Further still, it is understood that any of a variety of processes or combination thereof may be used to form container 30 and/or fitment 10, any component thereof, or any layer or substrate used therein. For example, any component, layer, or substrate, or combination thereof, may be thermoformed, injection molded, blow molded, coextruded, subjected to any other suitable process, or subjected to any combination thereof. In some embodiments, package 30 and/or fitment 10 and/or any component thereof may be formed substantially of injection molded PP. In some embodiments, container 30 and/or fitment 10 and/or any component thereof may be formed substantially of injection molded HDPE. In some embodiments, container 30 may be substantially thin, flexible, and/or pouch like, while fitment 10 may be more rigid. Various materials and/or processes may be used to form container 30 and/or fitment 10 and/or any component thereof as will be understood by one of ordinary skill in the art. In some embodiments, fitment 10 may be substantially a one-piece design and/or substantially formed as an integral or unitary structure. In such embodiments, mechanical stop 60 may be formed as a feature included within fitment 10 and without necessitating a feature external to fitment 10 to form a mechanical stop, such as a component of container or package 30 or some other feature external to fitment 10. In these exemplary embodiments, container 30 may be flexible and may be formed without a rigid area to form a portion of a mechanical stop with a portion of fitment 10, for example.

In an exemplary use of package 30 with fitment 10, a user may be provided with container 30, and the user may open lid 200 relative to base 100 by actuating an actuatable member such as latch mechanism 25. Lid 200 may open to an open position, where the interaction of a biasing member such as elastic band 50 with a stop member such as mechanical stop 60 may create a condition that maintains lid 200 in an open position at a desired angle. The user may pull one or more wipes 40 from package 30, then reclose and/or reseal lid 200 to base 100.

These and other modifications and variations may be practiced by those of ordinary skill in the art without departing from the spirit and scope, which is more particularly set forth in the appended claims. In addition, it should be understood that aspects of the various embodiments may be interchanged in whole or in part. Furthermore, those of ordinary skill in the art will appreciate that the foregoing description is by way of example only, and it is not intended to limit the scope of that which is described in the claims. Therefore, the spirit and scope of the appended claims should not be limited to the exemplary description of the versions contained herein.

That which is claimed:

1. A fitment for a container, comprising:

a base having an opening that permits access therethrough, the base including a base protrusion;

a lid operatively coupled to the base and movable between an open position relative to the opening and a closed position relative to the opening, the lid including a lid protrusion;

and a biasing member;

wherein the biasing member is coupled to the lid and is coupled to the base such that the biasing member urges the lid toward the open position when the lid is in the closed position relative to the base;

wherein the biasing member is an elastic band;

wherein the elastic band forms a continuous loop;

wherein the base protrusion and the lid protrusion cooperate to form a mechanical stop when the lid is in the open position, the mechanical stop configured to prevent opening of the lid past the open position.

2. The fitment of claim 1, wherein a latch release mechanism prevents movement of the lid by the biasing member until a user input actuates the release mechanism allowing movement of the lid by the biasing member.

3. The fitment of claim 1, wherein the mechanical stop prevents the lid from opening to 180 degrees relative to the base.

4. The fitment of claim 1, wherein the mechanical stop prevents the lid from opening past about 150 degrees relative to the base.

5. The fitment of claim 1, wherein the mechanical stop prevents the lid from opening past about 120 degrees relative to the base.

6. The fitment of claim 1, wherein the mechanical stop is operative while the biasing member is in tension and biasing the lid toward a position beyond the mechanical stop.

7. The fitment of claim 1, wherein the biasing member operates to rotatably open the lid relative to the base.

8. The fitment of claim 1, wherein the elastic band is held by at least one lid attachment protrusion extending outwardly away from a lid rear portion and at least one base attachment protrusion extending outwardly away from a base rear portion to at least partially form the continuous loop.

9. The fitment of claim 8, wherein the elastic band continuous loop is at least partially around an aperture that allows at least one of the lid protrusion and base protrusion to pass when the lid is moved from the closed position toward the open position to form the mechanical stop.

10. An apparatus, comprising:

a base having an opening therethrough and a lid operatively coupled to the base, wherein the lid has an open position that substantially permits access through the opening of the base, and wherein the lid has a closed position that prevents user access to the opening;

wherein in the open position the lid is at an angle of less than about 180 degrees relative to the base;

an elastic band operatively coupled to a lid portion and a base portion, wherein the elastic band is in a first tension when the lid is in the closed position and in a second tension when the lid is in the open position;

wherein the first tension urges the lid toward the open position; and a latch mechanism comprising a cooperating latch lid portion on the lid and a cooperating latch base portion on the base, wherein the latch lid portion and latch base portion engage while the lid is in the closed position and are not engaged when the lid is in the open position.

11. The apparatus of claim 10, wherein the latch mechanism provides a holding force sufficient to retain the lid in the closed position until the latch mechanism is released by a user input.

12. The apparatus of claim 10, further comprising a mechanical stop formed by cooperation of a lid protrusion coupled to the lid and a base protrusion coupled to the base when the lid is in the open position.

13. The apparatus of claim 12, wherein the mechanical stop provides a holding force sufficient to overcome the second tension and retain the lid in the open position.

14. The apparatus of claim 10, wherein in the open position the lid is at an angle of less than about 150 degrees relative to the base.

15. The apparatus of claim 10, wherein in the open position the lid is at an angle of less than about 120 degrees relative to the base.

16. The apparatus of claim 10, wherein in the open position the lid is at an angle in the range of about 100 degrees to about 120 degrees relative to the base.

17. The apparatus of claim 10, wherein in the open position the lid is at an angle of about 110 degrees relative to the base.

18. The apparatus of claim 10, wherein the first tension and the second tension vary in magnitude.

19. The apparatus of claim 10, wherein the first tension and the second tension vary in direction when the base is in the same orientation relative to a horizontal plane.

20. The apparatus of claim 10, wherein the elastic band operates to rotatably open the lid relative to the base.

* * * * *